US009140124B2

(12) United States Patent
Kobayashi et al.

(10) Patent No.: US 9,140,124 B2
(45) Date of Patent: Sep. 22, 2015

(54) EXCAVATION MACHINE

(75) Inventors: Masanori Kobayashi, Tokyo (JP); Kazuya Kokai, Tokyo (JP); Yasuharu Hanaoka, Osaka (JP)

(73) Assignee: HITACHI ZOSEN CORPORATION, Osaka (JP)

( * ) Notice: Subject to any disclaimer, the term of this patent is extended or adjusted under 35 U.S.C. 154(b) by 0 days.

(21) Appl. No.: 14/112,793

(22) PCT Filed: Jun. 27, 2012

(86) PCT No.: PCT/JP2012/004153

§ 371 (c)(1),
(2), (4) Date: Dec. 13, 2013

(87) PCT Pub. No.: WO2013/005382

PCT Pub. Date: Jan. 10, 2013

(65) Prior Publication Data

US 2014/0084668 A1 Mar. 27, 2014

(30) Foreign Application Priority Data

Jul. 1, 2011 (JP) ..... 2011-147283

(51) Int. Cl.
*E21D 9/11* (2006.01)
*E21D 9/08* (2006.01)

(52) U.S. Cl.
CPC ..... *E21D 9/112* (2013.01); *E21D 9/081* (2013.01)

(58) Field of Classification Search
CPC ..... E21D 9/112; E21D 9/081; E21D 9/1086; E21D 9/11; E21D 2009/084; E21C 27/00
USPC ..... 299/55, 56, 57, 58, 59, 60
See application file for complete search history.

(56) References Cited

U.S. PATENT DOCUMENTS

| | | | | | |
|---|---|---|---|---|---|
| RE25,470 | E | * | 11/1963 | Alliman | 299/56 |
| 3,412,816 | A | * | 11/1968 | Lautsch | 175/106 |
| 3,510,170 | A | * | 5/1970 | Wilms | 299/33 |
| 4,998,776 | A | * | 3/1991 | Chida et al. | 299/59 |
| 5,437,500 | A | * | 8/1995 | Lehmann et al. | 299/60 |
| 2004/0093768 | A1 | * | 5/2004 | Sakae et al. | 37/244 |

FOREIGN PATENT DOCUMENTS

| | | |
|---|---|---|
| JP | 9-209692 | 8/1997 |
| JP | 9-273379 | 10/1997 |
| JP | 3244603 | 1/2002 |

OTHER PUBLICATIONS

International Search Report, mail date is Oct. 9, 2012.

* cited by examiner

*Primary Examiner* — John Kreck
*Assistant Examiner* — Carib Oquendo
(74) *Attorney, Agent, or Firm* — Greenblum & Bernstein, P.L.C.

(57) ABSTRACT

An excavation machine having a cutter head with a large diameter while making it possible to excavate excavation objects such as hard bedrock etc. with high efficiency is provided. The excavation machine comprises an outer circumference cutter head 20 having a circular opening and being rotated and contacted to excavation objects and a small diameter cutter head 23 disposed in the opening and rotatable independently from the outer circumference cutter head. Rotation centers of the rotation disk and the rotation plate are gapped and the gap is shorter than a rotation radius of the small diameter cutter head.

7 Claims, 4 Drawing Sheets

PRIOR ART (b)

PRIOR ART (c)

EXCAVATION MACHINE

TECHNICAL FIELD

The present invention relates to an excavation machine for excavating a tunnel, and more particularly relates to an excavation machine for making it possible to excavate firm ground with high efficiency.

When constructing a tunnel through the bedrock or the underground, a shield machine is used to excavate them as an excavation machine. The shield machine comprises a rotating plate so called as a cutter head which is pressured to a working face (excavation face) at the end of the tunnel. The cutter head is radially disposed with small blades named as cutter bits which protrude from a circular surface and the cutter bits are made from tough substances such as super alloys or sintered tungsten carbide etc. so as not to be broken when they contact to hard stones and/or rocks.

By using such shield machine, rotating the cutter head, and then pressing it to the working face, the cutter bits encroach to soil and cuts the soil to construct the tunnel with almost circular cross section. Here, when constructing the shield tunnel, the shield machine excavates the earth and sand and sequentially primary lining engineering is applied so as to prevent the bedrock etc. from its fall down by constructing blocks (segments) shaped to arch and made from steel and/or reinforced concrete to place adjacent to a tunnel wall and then second lining engineering is applied by wrapping the inner surface of the tunnel with concrete to finish the construction of the shield tunnel. The above secondary lining engineering may protect the primary lining region and may reduce surface roughness.

FIG. 1(*a*)-(*c*) shows a front view of the cutter head used in a conventional shield machine. The cutter head shown in FIG. 1(*a*) comprises the members named to the cutter spokes 60 extending radially outwardly and the openings named as the cutter slits 10 extending between the cutter spokes. The cutter bits 11 are arranged and disposed with a constant spacing along with the cutter spokes 60 in the direction that the cutter spokes 60 extend. At the center thereof, the plate-shaped bit 12 is disposed and the disk cutters 13 having the circular disk shape, which may be protruded and may be pulled back, are disposed at the both sides.

Here, the cutter slits 10 are the openings for gathering the earth and sand which has been cut and removed by the cutter bits 11 and for sending the earth and sand to an isolation room disposed at another face of the cutter head, i.e., the back face opposite to the face to which the cutter bits 11 are disposed.

The cutter head shown in FIG. 1(*b*) is also disposed with the cutter spokes 60 extending radially outwardly and a plurality of cutter bits 11 are arranged and disposed with a constant spacing along with the cutter spokes 60. However, in this embodiment, the circular opening is formed at the center thereof and the second cutter head 14 with a smaller diameter is disposed to hinder the opening.

The second cutter head 14 is also disposed with the cutter spoke 65 extending radially outwardly on one face of the circular plate and a plurality of cutter bits 16 are arranged and disposed at a constant spacing along with the cutter spoke 65. In addition, the bits 17 with the plate shape are disposed in the crossed arrangement at the center thereof so as to enhance cutting performance around the center. In the described example, the cutter head and the second cutter head 14 have the same rotation center and each of the cutter heads is constructed such that they may rotate independently.

The cutter head shown in FIG. 1(*c*) is also disposed with the cutter spoke 60 extending radially outwardly and a plurality of cutter bits 11 is arranged and disposed at a constant spacing along with the cutter spoke 60. In this example as FIG. 1(*a*), the bit 12 with the plate shape is disposed for enhancing the cutting performance around the center while the rotation cutting apparatus 18 is disposed at the both sides thereof.

In any one examples, the excavation performance around the center is enhanced by contriving the constructions and the structures at around the center; however, the excavation performance at the center region decreases significantly since the cutter bits 11 disposed at the outer periphery move at higher speed and the bits 12 around the center move at lower speed. In this case, when the objects for excavating are hard objects, the cases that excavation time duration may become long or excavation itself can be failed may be possible. In FIGS. 1(*b*) and (*c*), the second cutter head 14 or the rotatable cutting apparatus 18 is disposed at the center portion and the harder objects may be cut by rotating the cutter head 14 or the rotatable cutting apparatus at high speed; however, the movements of the bits 12, 17 are slow and then the excavation of the subjected region requires long time or fails at the hard object part contacting to the bits 12, 17.

Therefore, the above excavation machines using the cutter bits 11, 16 all encounter the difficulty in direct excavation of the bedrock or the ground being hard in its nature, the bedrock or ground applied with hard improvement treatment and/or the structural objects such as the wall face of shield tunnels which is made from concrete. Recently, multi-lined traffics have proceeded for realizing smooth traffic flows and then usage of the cutter head having a large diameter has been increased. In the case of the large diameter cutter head, the speed of the bits 12 at the center region becomes slower and slower and then the cutting of the hard objects for the excavation becomes harder and harder than ever.

Even if the hard excavation objects may be cut by the cutter bits, flow performance and mixing performance of the earth and sand cut and removed are bad since the moving speed of the bits 12 at the center region is low such that the earth and sand may not be taken into the cutter slits 10, 15 to cause the blockade of the cutter slits. In such case, the excavation may not be smoothly continued.

With regard to the problem described above, conventionally a worker enters in front of the shield machine beforehand and the worker removes the earth and sand cut from the hard objects and/or the worker removes the earth and sand inside the cutter slits 10, 15 etc. when the blockade occurs. However, such circumstances raise the problem in the worker safety and the tunnel construction work may be significantly delayed by lowering workability.

When hard objects are present in the underground rather than the case for excavation of such hard bedrock etc., a shield excavation machine has been proposed, which is disposed with a rotatable sub-cutter head at the center region of a main cutter head; a plurality of auxiliary cutter heads are equipped on the face plate portion of the main cutter head such that the auxiliary cutter head may freely move forward and back with respect to the face plate portion of the main cutter head; and when there is the object in the natural ground, the objects may be cut etc. by protruding the auxiliary cutter heads toward the front (For example, Patent Literature 1).

By using the above shield excavation machine, the above described hard objects may be cut out easily and quickly by protruding the sub-cutter head at the center region and a plurality of the auxiliary cutter heads, which are arranged to be shifted radially from the center portion, toward the front direction. Thereby ensured safety of the workers and the workability may be significantly improved.

PRIOR ART LITERATURE

Patent Literature

Patent Literature 1: Japanese Patent No. 3244603

SUMMARY OF INVENTION

Object for Addressing by Invention

However, the shield excavation machine of the above Patent Literature 1, when normal excavation is performed, the cutter heads are rotated in the condition that the sub-cutter head and the auxiliary cutter heads are pulled in, i.e., in the condition that they are displaced to the level of the face plate portion of the main cutter head such that the moving speed near the center of the cutter head becomes low. Then the excavation time become longer at the center region or the excavation could not be performed at all when the excavation objects are hard substances. Even if the earth and sand near the center region is excavated, the flow performance of the cut and removed soil may be bad to provide the possibility of the blockade.

In such case, the earth and sand around the center region may be excavated by rotating the sub-cutter head at the center portion, since the sub-cutter head is equipped coaxially to the main cutter head similar to the cutter head depicted in FIG. 1(*b*), the rotation speed near the center thereof is also low and then it is difficult to excavate the earth and sand hear the center. In this case, such region must be removed through hand works by the workers. This situation could not ensure safety of the workers and the workability may not be good.

Then, it has been long desired to provide an excavation machine which may excavate hard excavation objects efficiently while ensuring safety of workers with high reliability. Particularly, it has been long desired to provide an excavation machine having a large diameter cutter head which may excavate efficiently hard excavation objects.

Means for Addressing to Object

The present invention in regard to the above problems may provide an excavation machine for digging a tunnel comprising a circular rotation disk having a circular opening, the rotation disk being rotated and contacted to an excavation object, a rotation plate disposed in the opening and rotatable independently from the circular rotation disk, a plurality of cutter members being protruding from and disposed on one face of the circular rotation disk and the rotation plate for cutting the excavation object by the rotation of the rotation disk and the rotation plate and rotation centers of the rotation disk and the rotation plate are gapped and a gap therebetween is shorter than a rotation radius of the rotation plate.

As the rotation disk and the rotation plate having the gapped rotation centers and the gap therebetween is shorter than the rotation radius of the rotation plate, the excavation objects contacting to near the center of the rotation disk may be cut by the cutting members moving at high speed and being disposed at outer circumference of the rotation plate while the excavation objects contacting to near the center of the rotation plate may be cut by the cutting member moving at relatively high speed and being disposed at radially outer side than near center of the rotation disk. Then region which cannot be excavated will not be present.

In addition, since the excavation objects are cut by the cutting members moving relatively high speed in any position over the excavation objects to which the rotation disk and/or the rotation plate are contacted, the flow performance and/or the mixing performance will be improved such that the soil cut and removed may be smoothly gathered into the cutter slits so as to avoid blockade. This may be applied to an excavation machine having a large diameter cutter head thereby making it possible to construct a large diameter tunnel.

The rotation radius of the rotation plate may be from one sixth to one third of a diameter of the rotation disk. The rotation plate having the rotation radius of the above region makes it possible to excavate the whole excavation face in excellent efficiency. The gap between a rotation center of the rotation disk and that of the rotation plate may be from one fourth to three fourth of the rotation radius of the rotation plate.

The excavation machine comprises a first rotation support means for supporting the rotation disk along to circumferential direction of the rotation disk, a first driving means for transferring driving force to the rotation disk so as to rotate the rotation disk to the circumferential direction, a second rotation support means for rotatably supporting an outer end of the rotation plate to the circumferential direction at an inner wall of the opening in the rotation disk, and a second driving means at a back face to the face of the rotation disk to which a plurality of the cutter members are disposed for transferring driving force to the rotation plate so as to rotate the rotation plate to the circumferential direction. The outer circumference of the rotation plate is rotated by the second driving means in the condition that the outer circumference of the rotation plate is supported by the second rotation support means such that strong supporting force in turn large driving force may be obtained.

The second driving means may be disposed to the excavation machine body as the first driving means and the first rotation support means thereby the construction of the rotation disk may become simple and connection procedure from a power source to the second driving means and maintenance may become easy.

Besides, the second support means may be omitted thereby the supporting strength becomes lower; however, the rotation disk structure becomes simple such that particularly the case that a small diameter rotation disk as the rotation plate is used is realized easily.

The rotation plate may not be limited to one and the rotation plate may be disposed not less than two. In this embodiment, second driving means corresponding to numbers of the rotation plates may be disposed and the second driving means may be disposed to the excavation machine body. By providing a plurality of rotation plates, the cutting performance may be improved.

Advantage of Invention

Conventional excavation machines perform excavation by driving rotationally the circular cutter head about the center thereof such that the rotation speed of each cutting members becomes significantly low to result in low cutting speed such that the troubles such as the front blockade and difficulty in excavation etc. may be caused and the trouble such as the blockade inside a chamber due to lowering of the mixing performance. However, the excavation machine of the present invention has a highly reliable structure and the cutting speed and the mixing speed may be ensured over the entire working face such that the excavation performance may be maintained. Besides, the excavation machine of the present invention may excavate the hard wall face of an already-constructed tunnel when constructing a branched tunnel so that low cost, elaboration saving, and short construction term may be realized.

EMBODIMENT FOR PRACTICING INVENTION

Figure 1:
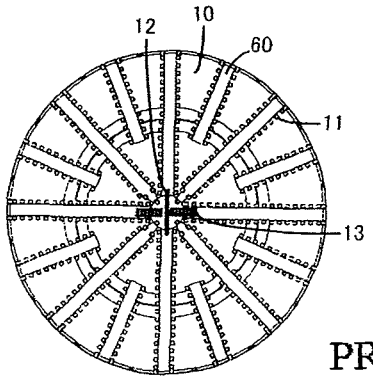
PRIOR ART Fig.1
FIGS. 1(*a*)-1(*c*) show a cutter head used in a conventional excavation machine.
Figure 1:
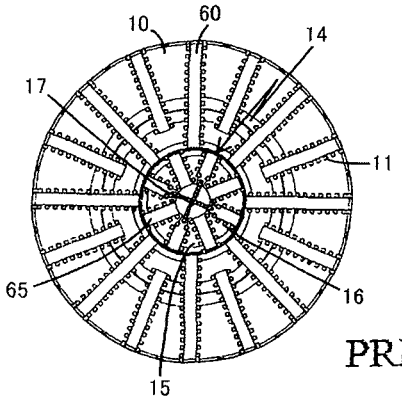
PRIOR ART Fig.1
Figure 1:
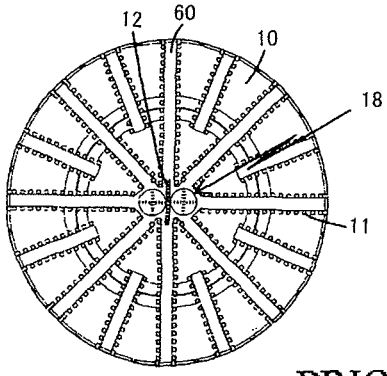
PRIOR ART Fig.1
Figure 2:
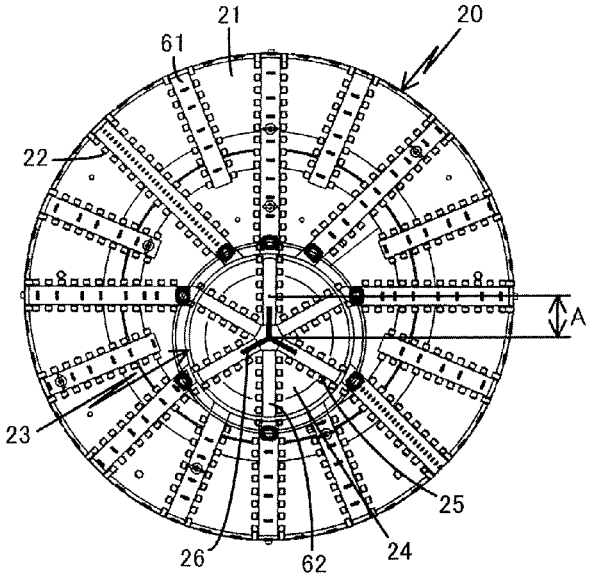
FIGS. 2(*a*) and 2(*b*) show a first embodiment of the present excavation machine.
Figure 2:
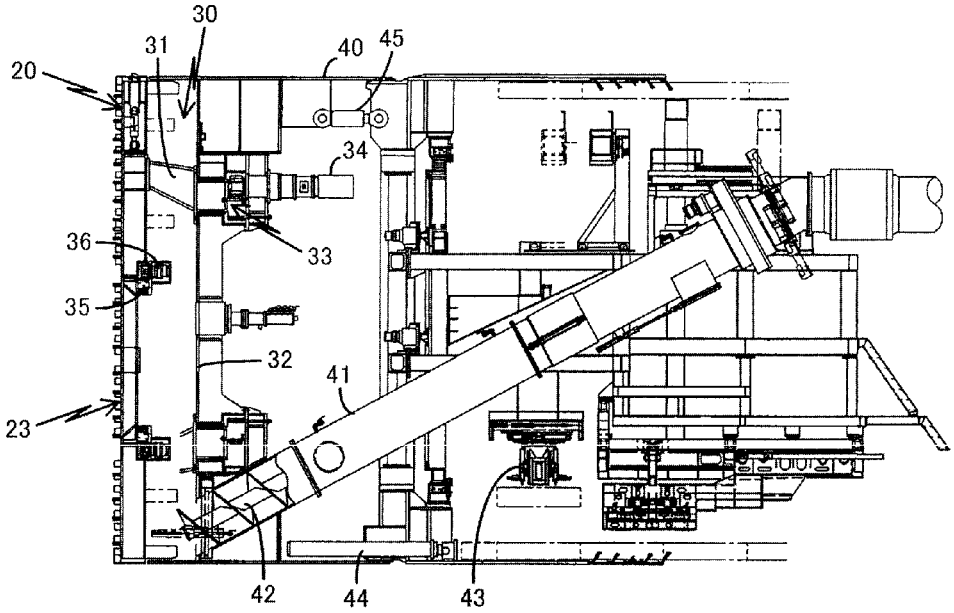

FIG. 2 shows one embodiment of the excavation machine of the present invention. FIG. 2(*a*) shows the front view of the cutter head and FIG. 2(*b*) shows the inside structure of the excavation machine. The excavation machine, similar to the conventional shield machine, comprises the outer circumference cutter head 20 as the rotatable disk for excavation the excavation object such as the bedrock or ground by being urged to the working face of the tunnel end. As shown in FIG. 2(*a*), the outer circumference cutter head 20 is formed with the cutter spoke 61 extending radially outwardly and a plurality of cutter bits 22 (cutting member) are arranged and disposed at a constant spacing along with the cutter spoke 61.

The cutter bits 22 are fine blades which protrude from one face of the outer circumference cutter head 20 and the cutter bits 22 are made from tough materials such as super alloys and/or sintered tungsten carbide etc. so as not to be broken by the contacts to hard stones and rocks. The outer circumference cutter head 20 may be made from steel materials having anti-abrasion performance such as chrome molybdenum steel or nickel chrome molybdenum steel. The cutter slit 21 are, as described above, the openings for sending the earth and sand cut by the cutter bits 22 to the isolation room 30 formed at the back face of the outer circumference cutter head 20, that is, the back side opposite to the front face to which the cutter bits 22 etc. are provided. Here, the cutter slits 21 continue to the rearward isolation room 30 and the earth and sand took therein are transferred to the isolation room 30 through the cutter slit 21.

The outer circumference cutter head 20 is disposed with the opening at the center portion and the small cutter head 23 as the smaller diameter rotation plate is placed therein such that the small cutter head 23 hinders the opening. Now, the rotation plate is assumed to have the circular shape, but not limited thereto, the rotation plate may be shaped to rectangular, elliptic, or crossed shapes. The small diameter cutter head 23 is disposed with the cutter spokes 62 extending radially outwardly similar to the outer circumference cutter head 20 surrounding the outskirt thereof and a plurality of cutter bits (cutting element) 25 are arranged and disposed at a constant spacing along with the cutter spoke 62.

The cutter slits 24 are the openings for sending to the isolation room 30 which is formed at the back side opposite to the front face to which the cutter bits 25 etc. are disposed so as to intake the earth and sand cut by the cutter bits 25 therein.

The small diameter cutter head 23 may rotate independently from the outer circumference cutter head 20 and does not have the coaxial rotation center with respect to the outer circumference cutter head 20. The rotation centers are gapped in the distance A and the distance A is designed to be smaller than the rotation radius of the small diameter cutter head 23. Here, at the center of the small diameter cutter head 23, the bit 26 with the plate shaped is disposed similar to conventional shield machine so as to improve the cutting performance.

The rotation radius of the small diameter cutter head 23 may preferably be from one sixth to one third of the diameter of the outer circumference cutter head 20. When the rotation radius is too large or too small, whole cutting face may not be excavated with acceptable efficiency. This is because of the defect when the rotation radius is smaller than one sixth, the objects pressurized to the outside of the small diameter cutter head 23 and also pressurized to the region near the center of the outer circumference cutter head 20 are cut by the cutter bits 22 with low moving speed placed near the center of the outer circumference cutter head 20 and when the rotation radius is larger than one third, the opening becomes large such that the strength of the outer circumference cutter head 20 and a driving means for rotating the small diameter cutter head 23 becomes large.

Besides, the distance A between the rotation centers of the outer circumference cutter head 20 and the small diameter cutter head 23 may preferably be from one fourth to three fourth of the rotation radius of the small diameter cutter head 23. When the distance is set in the above region, efficient excavation may be achieved.

As described above, by making the gap between the rotation centers of the outer circumference cutter head 20 and the smaller diameter cutter head 23 while setting furthermore the gap to be smaller than the rotation radius of the small diameter cutter head 23, the excavation objects such as bedrock and/or the ground contacting to near the center of the outer circumference cutter head 20 may be cut by the cutter bits 25 disposed at the outer periphery while moving at high speed; the excavation objects contacting to near the center of the small diameter cutter head 23 may be cut by the cutter bits 22 disposed at radially outer circumference and moving relatively higher speed to the cutter bits near center such that excavation time may not become longer and the case that the excavation is fail may be avoided.

Besides, the excavation objects pressurized to the outer circumference cutter head 20 or the smaller diameter cutter head 23 are, in any position, may be excavated by the cutter bits 25 moving to the circumferential direction at high speed or the cutter bits 22 moving to the circumferential direction at relatively high speed such that the flow and mixing performances of the cut and removed soil may be good and then they may be smoothly sent to the isolation room 30 at the rear direction. With respect to the cutter bits 22, 25 at any position the moving speeds thereof do not become to be near zero and have the speeds larger than certain levels such that the situation of the failure of excavation does not occur and the blockade by the excavated earth and sand may be avoided.

With referencing to FIG. 2(*b*), the outer circumference cutter head 29 and the small diameter cutter head 23 are equipped at the front of the excavation machine when the excavation direction of the excavation machine is assumed to be the front direction. The outer circumference cutter head is connected to the support bearing 33 as the first rotation support means disposed on the isolation wall 32 inside of the machine through the supports 31 for rotatably supporting the outer circumference cutter head 20. The support bearing 33 may, for example, comprise a ball bearing formed by an inner race, an outer race, and a plurality of balls inserted therebetween and a ring shaped member which is connected to the backward face of the inner race with respect to the excavation direction; the outer circumference thereof is applied with gear processing and the first driving motor 34 as the first driving means may be connected through a pinion, i.e., a small diameter gear engaging to the above gear.

The ball bearing rotatably supports the outer circumference cutter head 20 from the isolation wall 32 through the supports 31. The driving motor 34 may include a hydraulic motor and/or an electric motor and may activate the rotation of the outer circumference cutter head 20 to rotate in a constant direction through the rotation of the motor. More particularly, the pinion and the gear engage each other and the ring shaped member processed to have the gear rotates about the rotation center of the outer circumference cutter head 20 as the pinion rotates. The outer circumference cutter head 20 may rotate through the inner race which is connected to the ring shaped member and the support 31 continuing to the inner race.

In the embodiment shown in FIG. 2(*b*), for rotating and supporting the small diameter cutter head 23, for example, the swing bearing 35 as the second rotation support means may be disposed between the outer circumference of the small diameter cuter head 23 and the inner wall of the outer circumference cutter head 20 so as to support and rotate the small diameter cutter head 23. At the front side of the swing bearing 35, i.e. at the face side to which the cutter bits 22 are disposed, the sealing apparatus is disposed for closing tightly the driving portion including the driving motor 36 as the second driving means which rotates the small cutter bits (cutting member) 23 disposed at the back face thereof.

The swing bearing 35 may, for example, comprise a ball bearing formed by an inner race, an outer race, and a plurality of balls inserted therebetween and a ring shaped member which is connected to the inner race; the outer circumference thereof is applied with the gear processing similar to the above described embodiment. The outer circumference cutter head 20 comprises a container box for retaining the driving motor 36 in the spoke part 61 and the driving motor 36 is placed within the container box.

To the outer circumference of the ring shaped member, the gear processing is applied and the ring shaped member is supported rotatably by the ball bearing thereby the pinion connected to the driving motor retained in the container box and the gear therefor engage each other such that the rotational movement of the pinion by the driving motor 36 is transferred to the gear; then the small diameter cutter head may be rotated to a certain direction. Now, the driving motor 36 may also be a hydraulic motor. The supply of the hydraulic pressure to the hydraulic motor is performed through lines and the hydraulic motor and the hydraulic pump may be connected by a rotation connector because the small diameter cutter head 23 rotates to the certain direction.

In the embodiment shown in FIG. 2(*b*), the swing bearing 35 as the rotation support means for rotatably supporting the small diameter cutter head 23 and the driving motor 36 are disposed to the circumference cutter head 20. Since the small diameter cutter head 23 is supported rotatably by the swing bearing 35 at the outer circumference thereof, it may be securely supported such that large driving force may be obtained. Therefore, harder excavation objects may be excavated by urging it adequately to the working face.

Though the supporting bearing 33 and the swing bearing 35 both constructed by the ball bearing and the ring shaped member have been exemplified, the present invention is not limited thereto, each of the cutter heads may be supported rotatably by using any one of known means so as to rotate each of the cutter head independently.

The excavation machine comprises, besides above, the outer circumference cutter head 20, the small diameter cutter head 23, the isolation room 30 closed by the skin plate 40 for covering circumferentially and the isolation wall 32 which receives the excavated earth and sand taken from the cutter slits 21, and the casing 41 for discharging the received earth and sand rearward. The casing 41 is slantingly connected to the lower portion of the isolation wall 32 and the screw conveyer 42 as a transferring means for excavated earth and sand in the isolation room 30 is disposed therein. The screw conveyer 42 has the construction that a wing spirally extends about a center axis. The screw conveyer 42 is rotated by a motor etc. (not shown) about the center axis to transfer the excavated earth and sand rearward along with the continuously extending wing.

In addition, the excavation machine also comprises the segment assembling apparatus 43 for assembling segments used to the primary lining automatically. The segment assembling apparatus 43 comprises arms and grips each extending, contracting, moving forward and back and circling to construct a segment ring covering the inner face of the tunnel by continuously assembling arc shaped segments. Furthermore, the excavation machine comprises the shield jack 44 and the shield jack 44 pushes the end portion of the segment already fixed to move the excavation machine forward. Thereby the space is created in front of the fixed segments, and the segment assembling apparatus 43 constructs the segment ring into the circumference of the space. By repeating this procedure, the shield tunnel extending to the tunnel axis may be constructed.

The excavation machine further comprises the articulated jacks 45 to change the excavation direction. Any one of these jacks may be hydraulic jacks and these jacks may be assembled by a hydraulic pump for sending working oil to a hydraulic circuit by pressurizing it, a hydraulic motor for converging the hydraulic force obtained from the hydraulic pump to rotational movements, and a hydraulic cylinder for converting the rotational movements to linear movements. The excavation direction may be changed by extending the hydraulic cylinder at one side while contracting the hydraulic cylinder at the other side of the articulated jacks disposed at right and left sides with respect to the excavation direction.

While not consisting of the present excavation machine, a mud discharge pump may be connected continuously to the casing 41 at the rearward of the excavation machine and a gate may be disposed at the end of the casing 41 to transfer the earth and sand from the gate to a belt conveyer so as to discharge the excavated earth and sand to out of the tunnel.

At the rearward of the excavation machine, a power transmitter mounted on a cart and a cable reel mounted on a cart and the like are placed. The cable reel keeps the cable for supplying electric power from a battery to the power transmitter and the cable may be extracted as the power transmitter moves with respect to the excavation.

Figure 3:
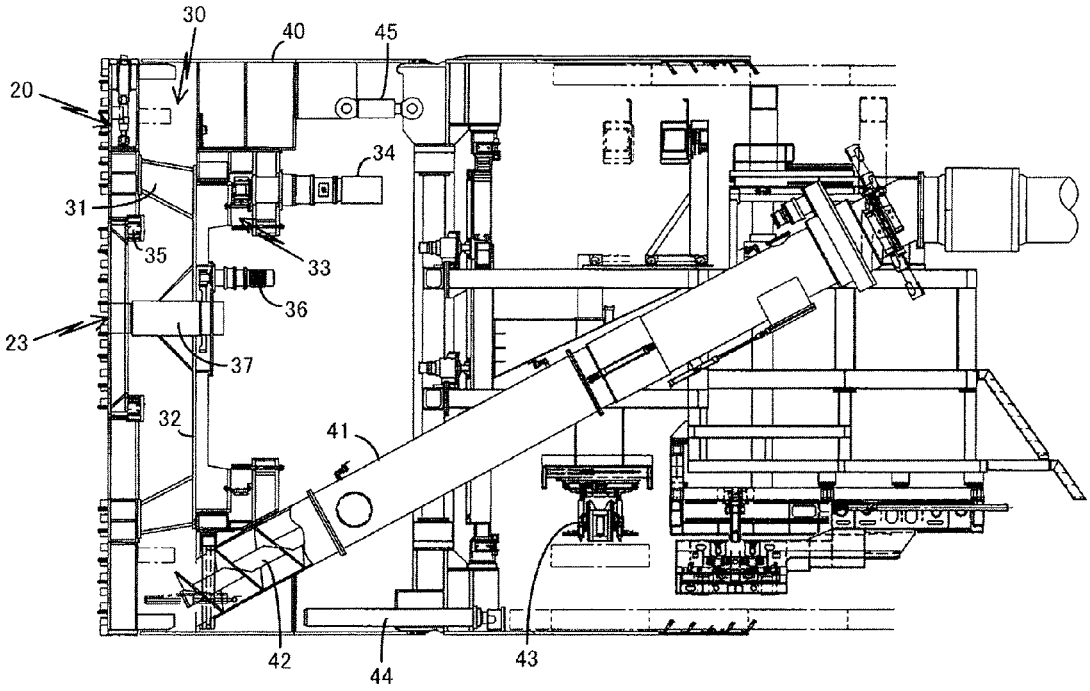
FIG. 3 shows another embodiment of the present excavation machine.

FIG. 3 shows the cross sectional view of the second embodiment of the excavation machine. Descriptions of the elements constructing the excavation machine will be omitted since those are similar to the first embodiment shown in FIG. 2(*b*) and then only the positions to which the driving motor for rotating the small diameter cutter head 23 are attached will be explained. Here, the small diameter cutter head is rotatably supported by the outer circumference cutter head 20 by the swing bearing 35 such that the small diameter cutter head hinders the opening disposed to the outer circumference cutter head. Then, the swing bearing 35 may be composed only by the ball bearing in the above embodiment and the ball bearing is disposed between the outer circumference end and the inside wall of the opening formed to the outer circumference cutter head 20.

In the first embodiment shown in FIG. 2, the driving motor 36 is disposed in the container box disposed to the outer circumference cutter head 20; however, in the second embodiment, the driving motor is disposed to the isolation wall 32. To the isolation wall 32, the hollow cylinder 37 is disposed as the rotation center of the small diameter cutter head 23 at the position gapped to be about the distance A from the rotation center of the outer circumference cutter head. Within the hollow cylinder the supporting axis of which top end is connected to the rotation center of the small diameter cutter head 23 is inserted therethrough so as to rotatably support the small diameter cutter head 23. To the opposite end of the supporting axis, a disk shaped member of which outer circumference is applied with the gear processing. The driving motor 36 transfers the rotation movement to the pinion connected to the driving motor 36 to rotate the disk shaped member by engaging the pinion with the gear, thereby the supporting axis rotates with respect to the rotation of the disk shaped member and the small diameter cutter head 23 rotates to a certain direction with respect to the rotation of the supporting axis.

As described above, by disposing the driving motor 36 to the isolation wall 32 of the machine body, it is not required to dispose the driving motor 36 with providing the container box to the small diameter cutter head 23 and the structure of the swing bearing 35 may become simple so that the structure of the outer circumference cutter head 20 may become simple and light weighted. Then the power consumption may be reduced and connection procedures to the power source and maintenances may become easy.

In the embodiment hereinbefore described, the assemblage of the small diameter cutter head 23 to the outer circumference cutter head 20 have been performed by using the swing bearing 35 thereby attaining strong supporting force; however, when such strong supporting force is not required, it may be possible to adopt the structure which does not use the swing bearing 35. For example, in the excavation machine shown in FIG. 3, the swing bearing 35 may be omitted; the construction which only the supporting axis is simply passed through the hollow cylinder 37 may be adopted thereby rotatably supporting the small diameter cutter head 23.

As the result, the construction of the outer circumference cutter head 20 may be simplified and light weighted so that the power consumption may be reduced as well as easy connection process and maintenance for the driving motor 36. However, this embodiment may not provide strong supporting force and when the excavation objects are hard, there may be the possibility that the rotation of the small diameter cutter head 23 could fail upon contacting the small diameter cutter head to the objects. If this is the case, the adequate excavation could not be performed. Then, it may be possible to adopt the construction that a plurality of small diameter cutter heads 23 are disposed thereto so as to make it possible to perform adequate excavation of the objects without stronger contacting force.

Figure 4:
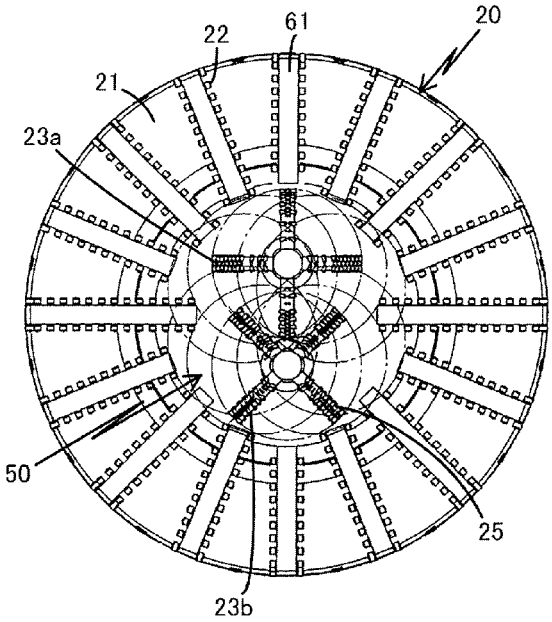
FIGS. 4(*a*) and 4(*b*) show another embodiment of the present excavation machine.
Figure 4:
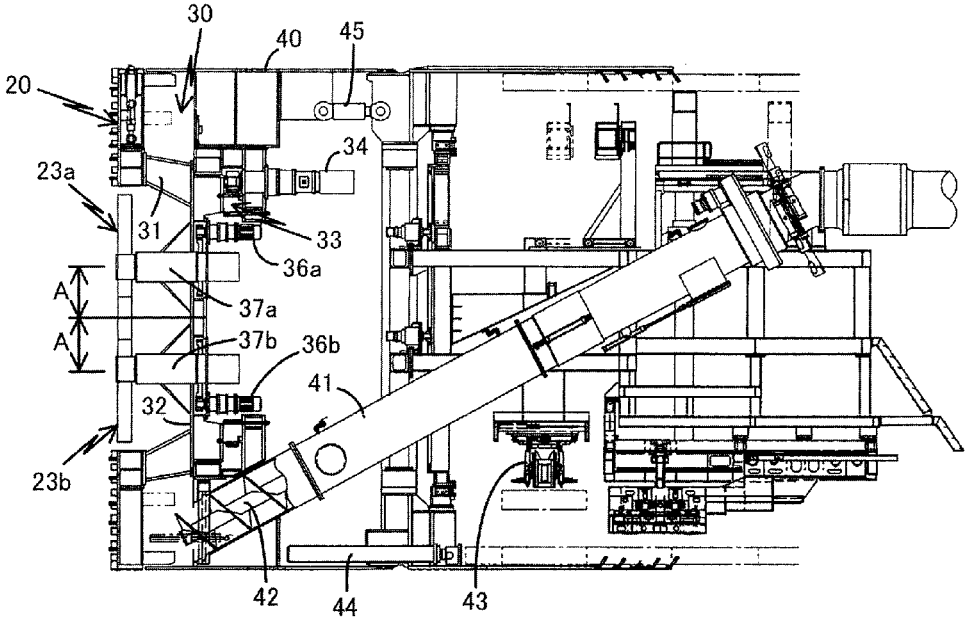

The construction above described is shown in FIGS. 4(*a*), (*b*). In FIGS. 4(*a*), (*b*), the opening 50 having generally circler shape is formed at the center portion of the outer circumference cutter head 20 while the center of the opening being arranged to be co-axial to the rotation center of the outer circumference cutter head 20. In the opening 50, two cross shaped rotation plates are disposed as the small diameter cutter head 23*a*, 23*b*. These rotation plates may be formed by welding four rectangular plates at the every 90 degrees to the circular plate, and the like.

There small diameter cutter heads 23*a*, 23*b* may be arranged so as to overwrap the trajectories shown by the broken lines and the rotation s are controlled so as to synchronize the rotations each other while not to cause interference therebetween. Therefore, each of the wings constructing the small diameter cutter head 23*a*, 23*b* is controlled to be the same rotational speeds so as to avoid the collision of them. On the surface on each of the rectangular plates, a plurality of cutter bits 25 are aligned and disposed such that the transfer to the isolation room 30 through the opening 50 may be attained.

To the rotation center on the back face of the small diameter cutter heads 23*a*, 23*b*, the top end of the supporting axis is connected and the hollow cylinders 37*a*, 37*b* are disposed such that the rotation axes of them are positioned at gapped to be about the distance A from the rotation center of the outer circumference cutter head 20 and each of the supporting axes are pass through the hollow cylinders 37*a*, 37*b*. Thereby the small diameter cutter heads 23*a*, 23*b* may be rotatably retained, and moreover, the distance A may be set to be shorted than the rotation radiuses of the small diameter cutter heads 23*a*, 23*b*.

The opposite ends of the supporting axes are disposed with rig shaped members to which gear processing are provided at the outer circumferences. The driving motors 36*a*, 36*b* transfer the rotational movements to the pinions connected to the driving motors 36*a*, 36*b* to engage the pinions and the gears to transfer to the small diameter cutter heads 23*a*, 23*b* through the supporting axes so as to rotate the small diameter cutter heads 23*a*, 23*b* to certain directions.

Since the outer circumference cutter head 20 merely has the opening 50 at the portion which receives the small diameter cutter heads 23*a*, 23*b* and the opening 50 has the dimension sufficiently receiving thereof, the simple construction may be realized. Also since the driving motors 36*a*, 36*b* are disposed to the machine body, the connection processes of the driving sources and the maintenances may become easy.

The excavation machine realizes excellent cutting performance in the excavation for improved bedrock and constructions etc. as well as hard bedrock and then the construction of the tunnels having the joint junction into one or having the branch junction diverging two direction may be constructed for example by cutting directly the already constructed hard tunnel wall. The excavation machine may be addressed to the case that the cutting is performed along with the tunnel wall while thinning the tunnel wall in little amounts as well as to the case that the cutting is performed in the perpendicular to the already constructed tunnel wall.

Although the excavation machine of the present invention has been described with referring to embodiments depicted in the drawings so far, the present invention must not be limited to the above embodiments and modifications such as other embodiments, additions, alternations, and deletions may be made so far as a person with an ordinary skill in the art may reach and any embodiment which may provide the technical function and work should be included within the scope of the present invention. Therefore, as described above, the shape of the rotation disk may be selected from any shape such as, for example, rectangular, elliptic or cross shapes other than the disk shape and rotation supporting means other than the ball bearing may be used.

DESCRIPTION OF SIGNS

10—cutter slit, 11—cutter bit, 12—bit, 13—disc cutter, 14—second cutter head, 15—cutter slit, 16—cutter bit, 17—bit, 18—rotation cutting apparatus, 20—outer circumference cutter head, 21—cutter slit, 22—cutter bit, 23, 23*a*, 23*b*—small diameter cutter head, 24—cutter slit, 25—cutter bit, 26—bit, 30—isolation room, 31—support, 32—isolation wall, 33—supporting bearing, 34—driving motor, 35—swing bearing, 36,36*a*,36*b*—driving motor, 37—hollow cylinder, 40—skin plate, 41—casing, 42—screw conveyer, 43—segment assembling apparatus, 44—shield jack, 45—articulated jack, 50—opening, 60,61,02,65—cutter spoke

The invention claimed is:

1. An excavation machine for digging a tunnel comprising:

a circular rotation disk having a circular opening, the rotation disk being rotated and contacted to an excavation object;

a rotation plate disposed in the opening and rotatable independently from the circular rotation disk; and a plurality of cutter members protruding from and disposed on one face of the circular rotation disk and the rotation plate for cutting the excavation object by the rotation of the rotation disk and the rotation plate;

wherein rotation centers of the rotation disk and the rotation plate are gapped and a gap therebetween is shorter than a rotation radius of the rotation plate.

2. The excavation machine of claim 1, wherein the excavation machine comprises a first rotation support for supporting the rotation disk along to circumferential direction of the rotation disk, a first driver for transferring driving force to the rotation disk so as to rotate the rotation disk to the circumferential direction, a second rotation support for rotatably supporting an outer end of the rotation plate to the circumferential direction at an inner wall of the opening in the rotation disk, and a second driver, for transferring driving force to the rotation plate so as to rotate the rotation plate to the circumferential direction, is at a back face to the face of the rotation disk that has the plurality of the cutter members disposed thereon.

3. The excavation machine of claim 1, wherein the excavation machine comprises a first rotation support for supporting the rotation disk along to circumferential direction of the rotation disk, a first driver for transferring driving force to the rotation disk so as to rotate the rotation disk to the circumferential direction, a second driver for transferring driving force to the rotation plate so as to rotate the rotation plate to the circumferential direction, and a second rotation support for rotatably supporting an outer end of the rotation plate to the circumferential direction at an inner wall of the opening in the rotation disk.

4. The excavation machine of claim 1, wherein the excavation machine comprises a first rotation support for supporting the rotation disk along to circumferential direction of the rotation disk, a first driver for transferring driving force to the rotation disk so as to rotate the rotation disk to the circumferential direction, and a second driver for transferring driving force to the rotation plate so as to rotate the rotation plate to the circumferential direction.

5. The excavation machine of claim 4, wherein the excavation machine comprises a plurality of the rotation plates and the second driver provided in numbers identical to numbers of the rotation plate.

6. The excavation machine of claim 1, wherein the rotation radius of the rotation plate is from one sixth to one third of a diameter of the rotation disk.

7. The excavation machine of claim 1, wherein a distance between a rotation center of the rotation disk and that of the rotation plate is from one fourth to three fourth of the rotation radius of the rotation plate.

* * * * *